US011808545B1

(12) United States Patent
Chu et al.

(10) Patent No.: US 11,808,545 B1
(45) Date of Patent: Nov. 7, 2023

(54) TRIGGER RESET DEVICE

(71) Applicant: Man Kung Enterprise Co., Ltd., Taichung (TW)

(72) Inventors: Fu-Hui Chu, Taichung (TW); Ching-Chi Hung, Taichung (TW)

(73) Assignee: Man Kung Enterprise Co., Ltd., Taichung (TW)

( * ) Notice: Subject to any disclaimer, the term of this patent is extended or adjusted under 35 U.S.C. 154(b) by 0 days.

(21) Appl. No.: 17/898,595

(22) Filed: Aug. 30, 2022

(51) Int. Cl.
*F41B 5/12* (2006.01)
*F41B 5/14* (2006.01)

(52) U.S. Cl.
CPC ..... *F41B 5/1469* (2013.01); *F41B 5/12* (2013.01)

(58) Field of Classification Search
CPC ..... F41B 5/12
See application file for complete search history.

(56) References Cited

U.S. PATENT DOCUMENTS

| | | | | |
|---|---|---|---|---|
| 6,736,123 | B1 * | 5/2004 | Summers | F41B 5/1469 124/40 |
| 7,770,567 | B1 * | 8/2010 | Yehle | F41A 17/46 124/40 |
| 9,435,605 | B2 * | 9/2016 | McPherson | F41B 5/12 |
| 9,523,549 | B1 * | 12/2016 | Hughes | F41B 5/1469 |
| 11,009,310 | B1 * | 5/2021 | Shaffer | F41B 5/1469 |
| 11,306,994 | B2 * | 4/2022 | Shaffer | F41B 5/12 |

* cited by examiner

*Primary Examiner* — John A Ricci

(57) ABSTRACT

A trigger reset device contains: a trigger seat, a drive element, a button, and an engagement switch. The trigger seat includes a channel, a string hook, a movable safety switch movably switched between an opening position and a closing position. The trigger seat includes a connection trigger, a receiving groove and a coupling trench, and the receiving groove has a lifting means. The drive element includes a slot and a controlled unit. The button includes a slidable sleeve portion. The engagement switch is rotatably accommodated in the coupling trench and includes a locating portion and a fifth spring defined between the engagement switch and the trigger seat, hence the spring abuts against the engagement switch so that the drive element is stopped by the locating portion of the engagement switch in the normal state and the button does not move to actuate the drive element to move.

10 Claims, 15 Drawing Sheets

TRIGGER RESET DEVICE

BACKGROUND OF THE INVENTION

Field of the Invention

The present invention relates to trigger device, and more particularly to a trigger reset device for a crossbow.

Description of the Prior Art

A conventional trigger device of a crossbow is applied to shoot an arrow. For example, a safety switch is pushed so that the trigger device cannot be pressed to avoid shooting the arrow when triggering the trigger carelessly. However, after a string of the crossbow is pulled to hook with a string hook and the arrow is not fixed on the trigger device, the string removes from the string hook to shoot the arrow idly, and a string pulling force cannot be transformed to a shooting speed, so the crossbow will bear the string pulling force to be broken, thus reducing a service life of the crossbow and damaging the arm and the string of the crossbow and user's and related people's safety.

To avoid above-mentioned problem, an anti-dry fire trigger device is provided with the crossbow so as to avoid triggering the trigger when the arrow is not fixed on the string, thus obtaining using safety. But as desiring to release the string, the anti-dry fire trigger device stops a releasing of the string, thus causing using inconvenience.

The present invention has arisen to mitigate and/or obviate the afore-described disadvantages.

SUMMARY OF THE INVENTION

The primary object of the present invention is to provide a trigger reset device by which when a string does not engage an arrow, a movable safety switch is located on a closing position, and a button mates with a connection trigger to remove from a string hook so as to release and reset the string conveniently.

To provide above-mentioned objects, a trigger reset device provided by the present invention contains: a trigger seat, a drive element, a button, and an engagement switch.

The trigger seat includes a channel extending backward from a middle section of a front end of the trigger seat, a string hook rotatably connected in the trigger seat, and a movable safety switch fixed on a rear end of the channel of the trigger seat. The movable safety switch is movably switched between an opening position and a closing position, and the trigger seat includes a connection trigger rotatably connected proximate to a bottom of the trigger seat. A first end of the connection trigger controls the string hook, and the connection trigger has an actuation portion formed on a second end thereof. The trigger seat further includes a receiving groove and a coupling trench which are defined adjacent to a rear end of the trigger seat, and the receiving groove is in communication with the coupling trench, the receiving groove has a lifting means.

The drive element is slidably received in the receiving groove of the trigger seat, and the drive element includes a slot defined adjacent to a bottom of the drive element and configured to engage with the actuation portion of the connection trigger. The drive element also includes a controlled unit arranged on a top thereof.

The button includes a slidable sleeve portion configured to slidably connect the button on the controlled unit of the drive element and to move with the lifting means. When the button is pressed and matches with the lifting means, the drive element is actuated to move upward. When releasing the button, the drive element moves downward to an original position.

The engagement switch is rotatably accommodated in the coupling trench of the trigger seat, and the engagement switch includes a locating portion formed on an end of the engagement switch, a fifth spring defined between the engagement switch and the trigger seat, hence the spring abuts against the engagement switch so that the drive element is stopped by the locating portion of the engagement switch in the normal state and the button does not move to actuate the drive element to move.

When the movable safety switch is located on the closing position, the engagement switch is pressed so that the drive element is not stopped by the locating portion of the engagement switch, and the button is pressed so that the button actuates the drive element to move upward, and the drive element drives the connection trigger to removes from the string hook.

DETAILED DESCRIPTION OF THE PREFERRED EMBODIMENTS

The present invention will be clearer from the following description when viewed together with the accompanying drawings, which show, for purpose of illustrations only, a preferred embodiment in accordance with the present invention.

Figure 1:
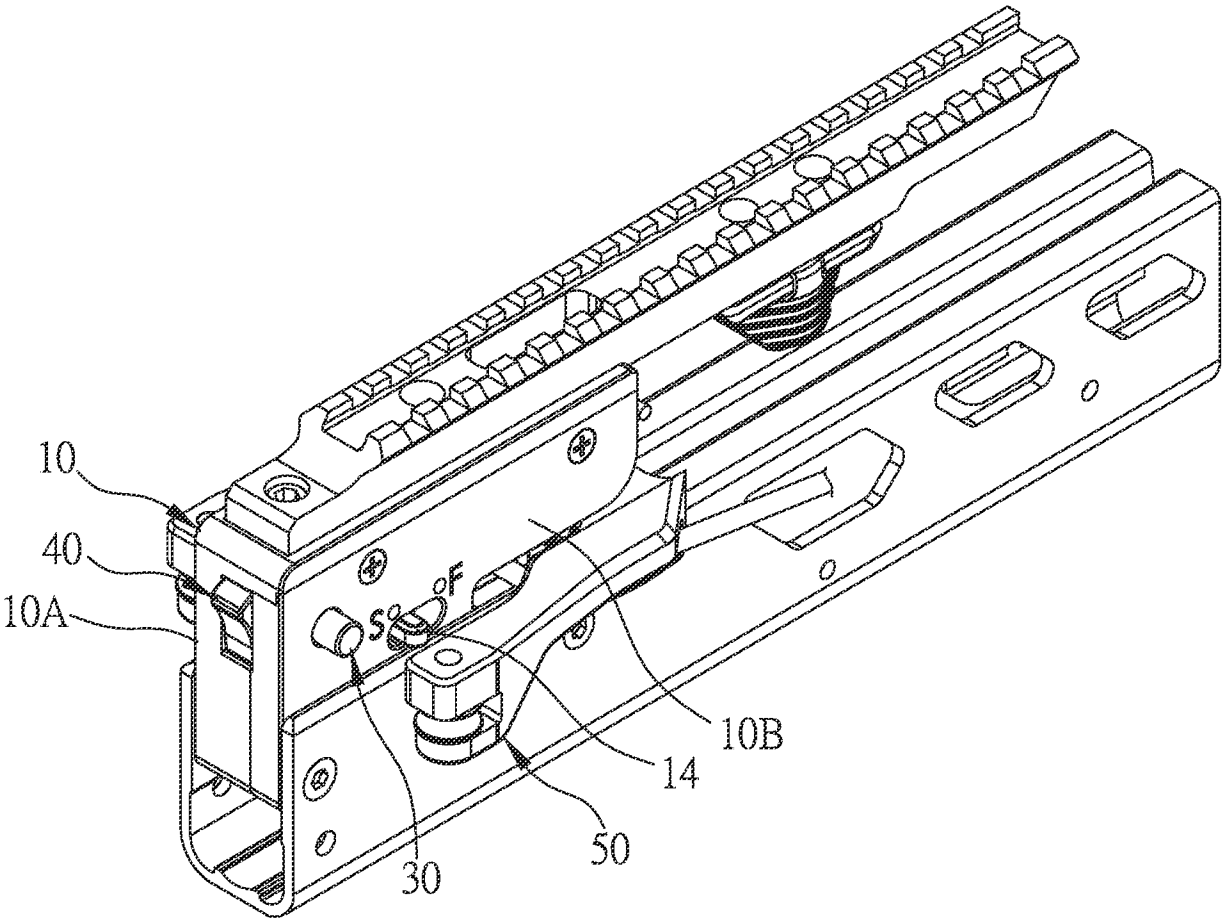
FIG. 1 is a perspective view showing the assembly of a trigger reset device according to a preferred embodiment of the present invention.
Figure 2:
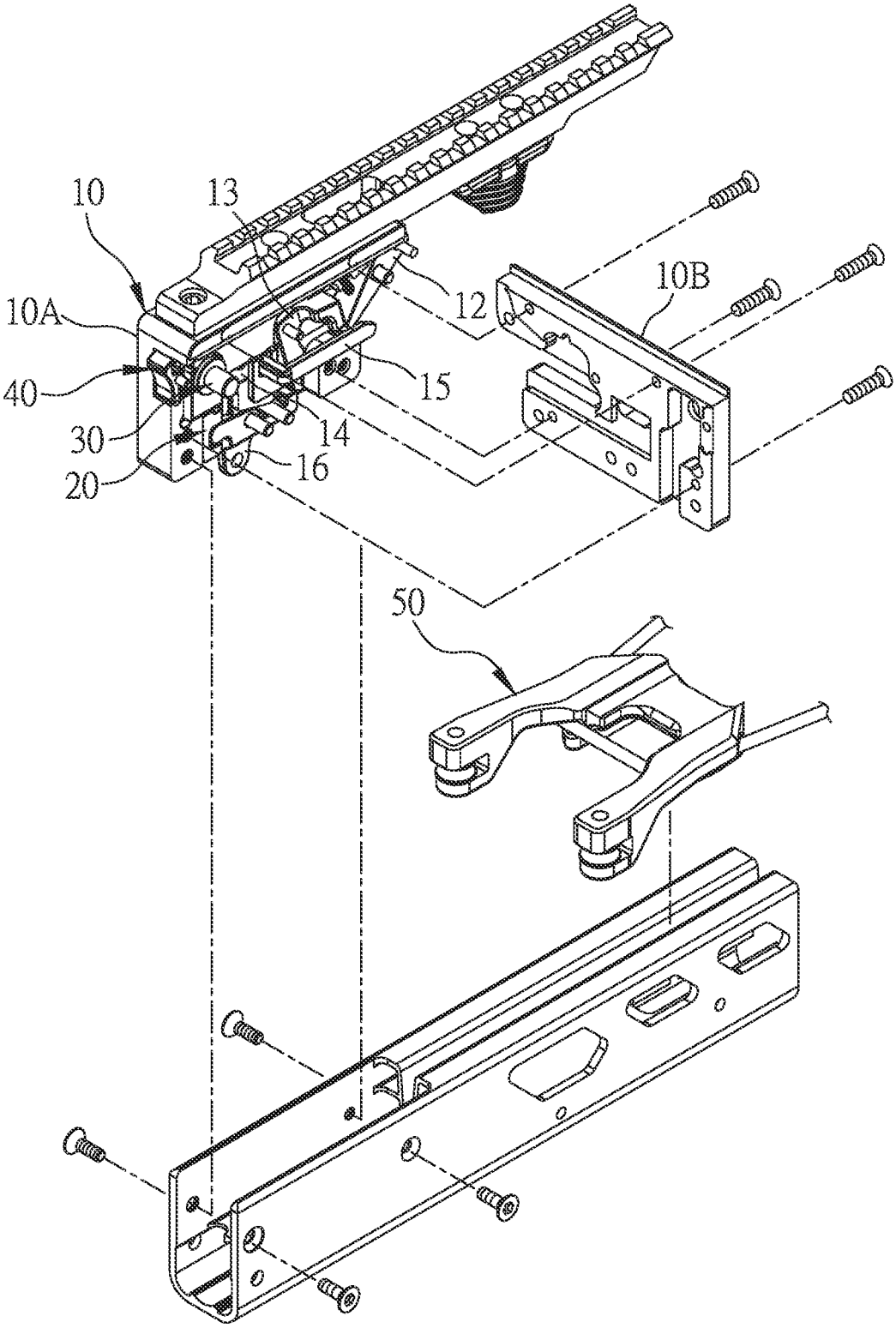
FIG. 2 is a perspective view showing the exploded components of the trigger reset device according to the preferred embodiment of the present invention.
Figure 3:
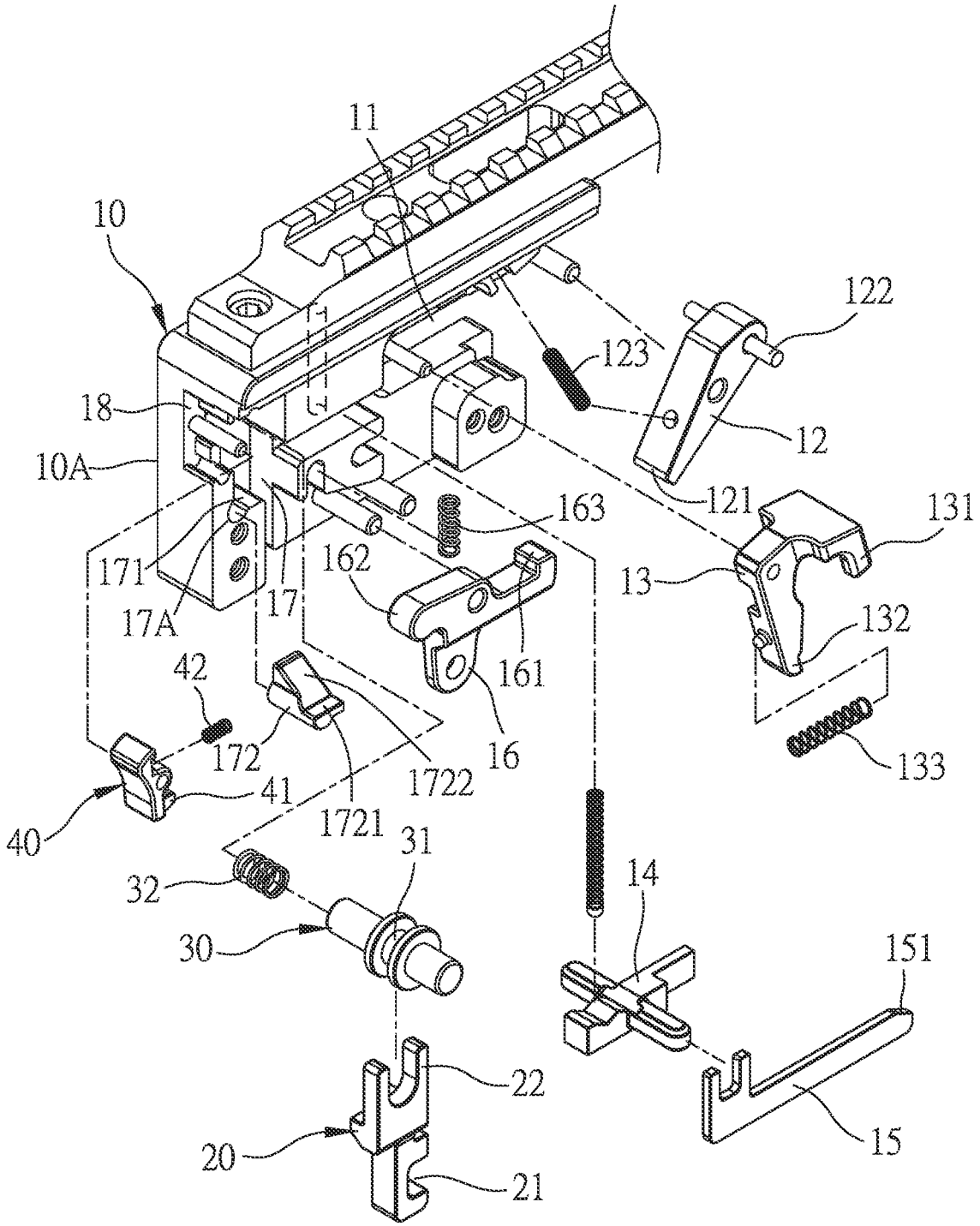
FIG. 3 is another perspective view showing the exploded components of the trigger reset device according to the preferred embodiment of the present invention.
Figure 4:
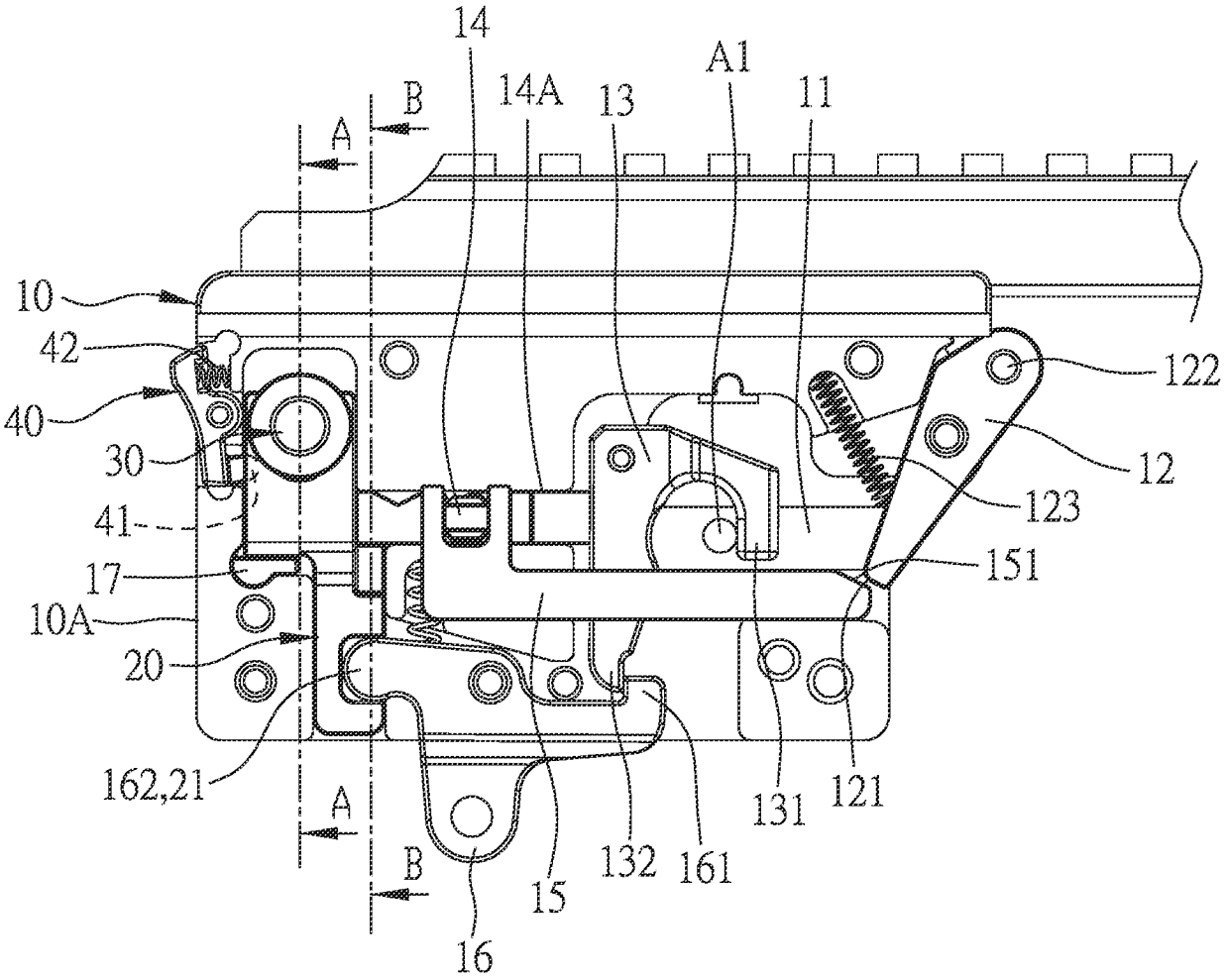
FIG. 4 is a side plan view showing the operation of the trigger reset device according to the preferred embodiment of the present invention.
Figure 5:
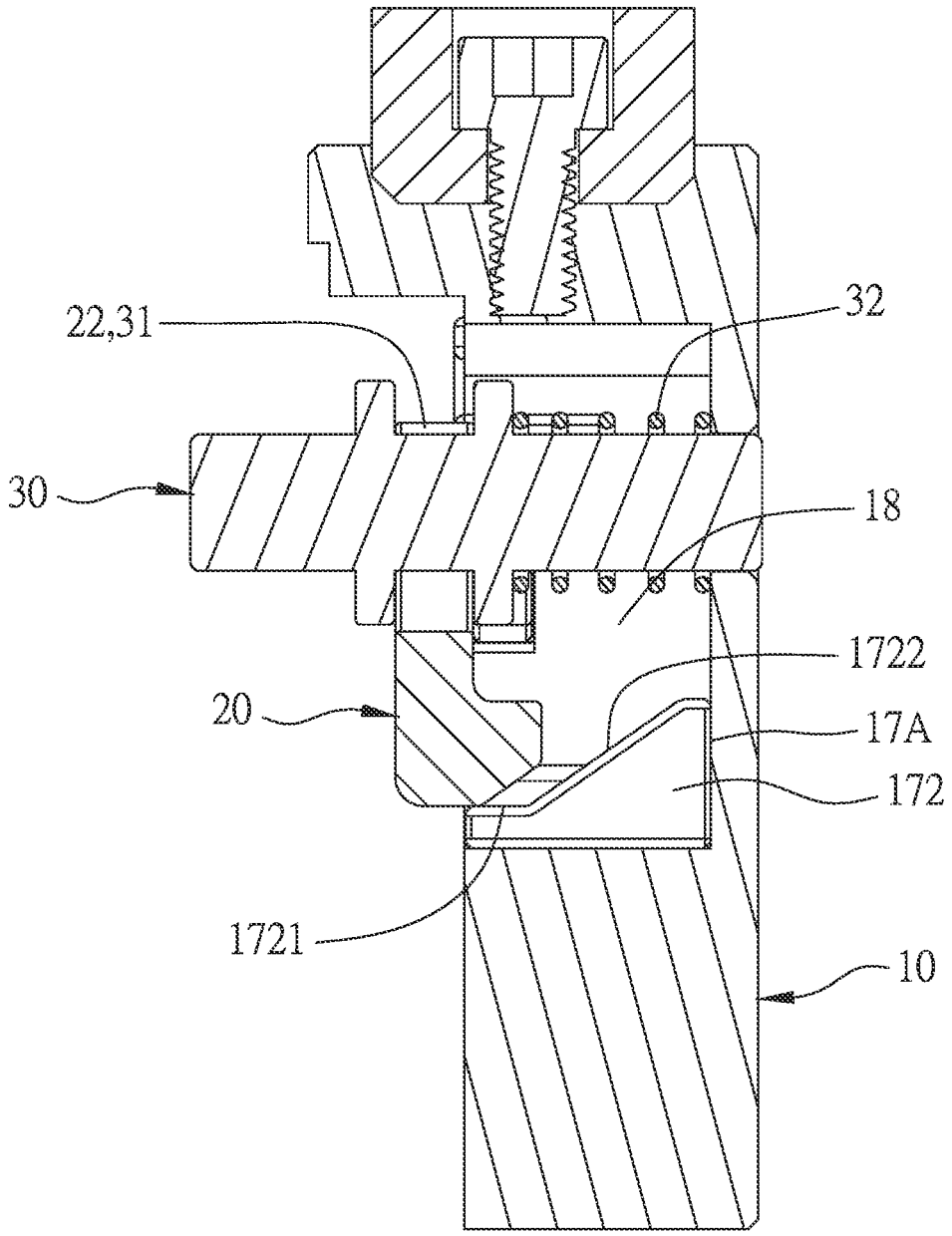
FIG. 5 is a cross sectional view taken along the lines A-A of FIG. 4.

With reference to FIGS. 1 to 5, a trigger reset device according to a preferred embodiment of the present invention comprises: a trigger seat 10, a drive element 20, a button 30, and an engagement switch 40.

The trigger seat 10 includes a first lid 10A, a second lid 10B covered with the first lid 10A, a channel 11 extending backward from a middle section of a front end of the trigger seat 10, and an arrow retainer 12 rotatably connected proximate to the front end of the trigger seat 10, wherein the arrow retainer 12 has an abutting portion 121 formed on a first end thereof, and the arrow retainer 12 has a defining portion 122 formed on a second end of the arrow retainer 12, a first spring 123 defined between the arrow retainer 12 and the trigger seat 10, such that the arrow retainer 12 is pushed by the first spring 123 to movably abut against the defining portion 122 and is limited by the defining portion 122. The trigger seat further includes a string hook 13 rotatably connected on a rear end of the arrow retainer 12 in the trigger seat 10, wherein the string hook 13 has a hooking portion 131 formed on a first end thereof, a retaining portion 132 formed on a second end thereof, and a second spring 133 defined between the string hook 13 and the trigger seat 10 so that the string hook 12 is pushed by the second spring 133, wherein the retaining portion 132 extends below the channel 11, and the trigger seat 10 further includes a movable safety switch 14 fixed on a rear end of the channel 11, wherein the movable safety switch 14 is movably switched between an opening position (not shown) and a closing position 14A, and the movable safety switch 14 is connected with a stop element 15 so that the stop element 15 is moved forward and backward with the movable safety switch 14. The stop element 15 has a limited portion 151 formed on an end thereof away from the movable safety switch 14, and the trigger seat 10 includes a connection trigger 16 rotatably connected proximate to a bottom of the trigger seat 10, wherein the connection trigger 16 has a fastening portion 161 extending from a first end thereof, and the connection trigger 16 has an actuation portion 162 formed on a second end thereof, wherein the fastening portion 161 is configured to engage the retaining portion 132 of the string hook 13, and a third spring 163 is defined between the connection trigger 16 and the trigger seat 10, such that the connection trigger 16 is pushed by the third spring 163, wherein the connection trigger 16 is not triggered in a normal state. The trigger seat 10 further includes a receiving groove 17 and a coupling trench 18 which are defined adjacent to a rear end of the trigger seat 10, and the receiving groove 17 is in communication with the coupling trench 18, the receiving groove 17 has a lifting means 17A, and the lifting means 17A has a stepped portion 171 formed on the receiving groove 17, a guide protrusion 172 connected with the stepped portion 171, wherein the guide protrusion 172 has a plane 1721 and a tilted face 1722 obliquely extending upward from the plane 1721.

The drive element 20 is slidably received in the receiving groove 17 of the trigger seat 10, and the drive element 20 includes a slot 21 defined adjacent to a bottom of the drive element 20 and configured to engage with the actuation portion 162 of the connection trigger 16. The drive element 20 also includes a controlled unit 22 arranged on a top thereof and formed in an U shape, wherein when the movable safety switch 14 is located on the closing position 14A, the drive element 20 is stopped by the movable safety switch 14 to not slide upward, so the connection trigger 16 is not be triggered.

The button 30 includes a slidable sleeve portion 31 configured to slidably connect the button 30 on the controlled unit 22 of the drive element 20 and to move with the lifting means 17A, wherein a portion of the button 30 extends out of the trigger seat 10, and the button 30 is pressed to actuate the drive element 20 to move horizontally along the plane 1721 of the guide protrusion 172 by mating with the lifting means 17A and to move upward along the tilted face 1722, wherein a fourth spring 32 is defined between the button 30 and the trigger seat 10 and is configured to push the button 30 to move back to an original position after pressing the button 30.

The engagement switch 40 is rotatably accommodated in the coupling trench 18 of the trigger seat 10, and the engagement switch 40 includes a locating portion 41 formed on an end thereof, a fifth spring 42 defined between the engagement switch 40 and the trigger seat 10, hence the fifth spring 42 abuts against the engagement switch so that the drive element 20 is stopped by the locating portion 41 of the engagement switch 40 in the normal state and the button 30 does not move to actuate the drive element 20 to move.

Figure 6:
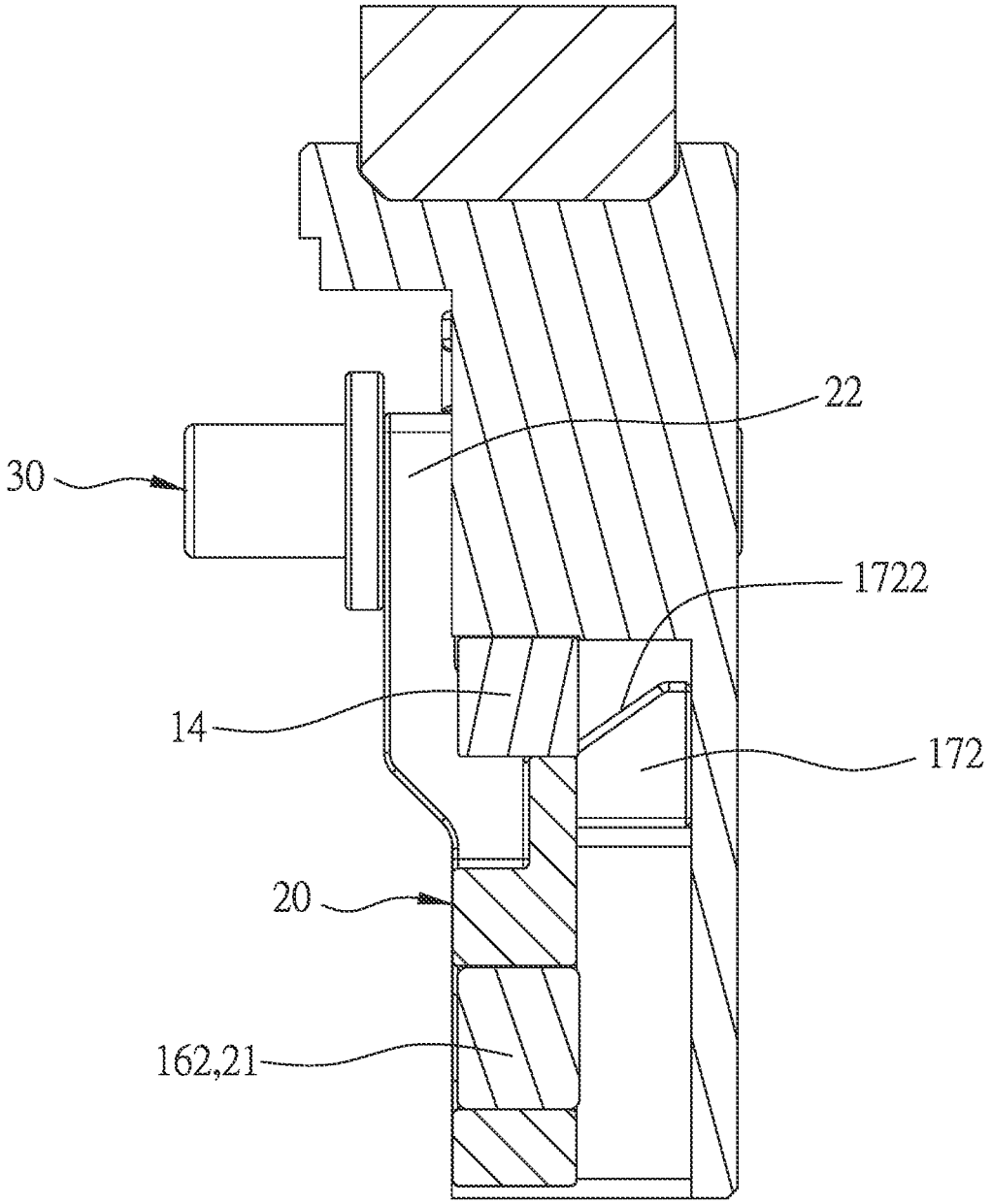
FIG. 6 is a cross sectional view taken along the lines B-B of FIG. 4.
Figure 7:
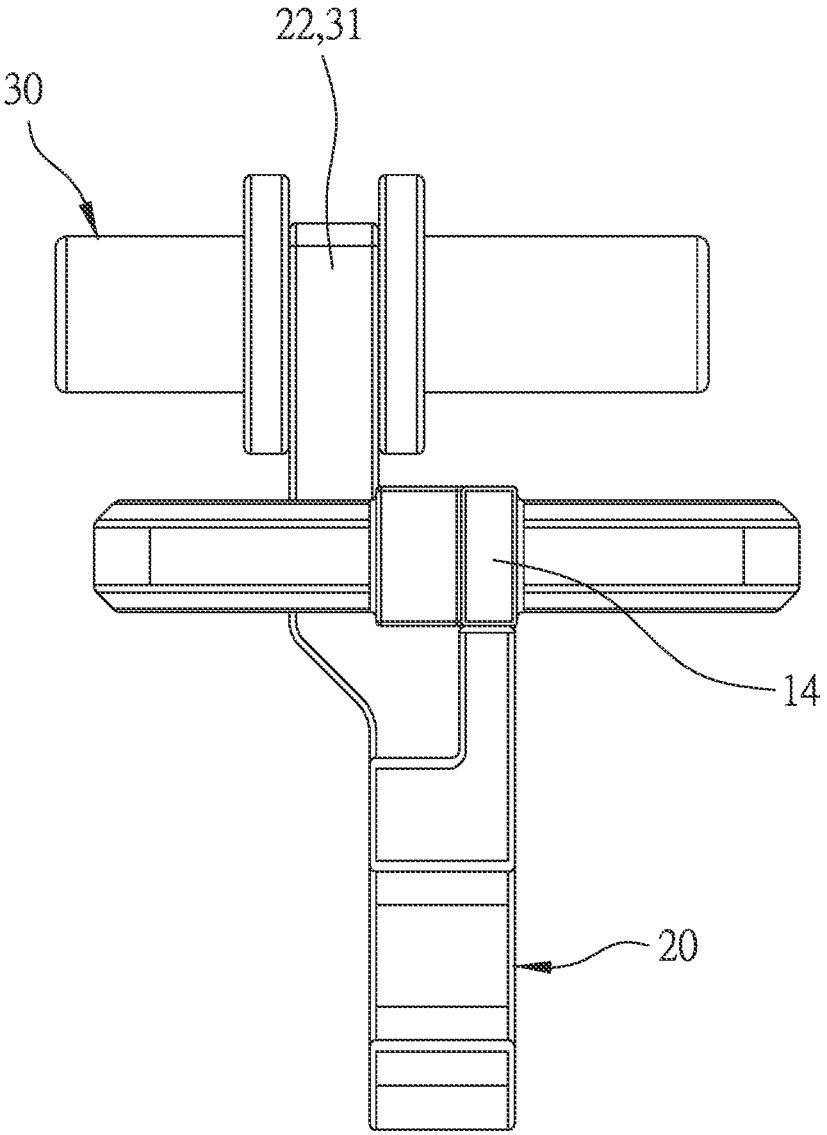
FIG. 7 is another side plan view showing the operation of the trigger reset device according to the preferred embodiment of the present invention.

Referring to FIGS. 4-7, when shooting, a string A1 is pulled backward to draw a bow (not shown) so that the string A1 hooks on the hooking portion 131 of the string hook 13, and the retaining portion 132 of the string hook 13 is engaged by the fastening portion 161 of the connection trigger 16. In the meantime, an arrow (not shown) is not fixed, and the abutting portion 121 of the arrow retainer 12 stops the limited portion 151 of the stop element 15 so that the movable safety switch 14 is limited by the stop element 15 and is not switched from the closing position 14A to the opening position, thus avoiding shooting.

Figure 8:
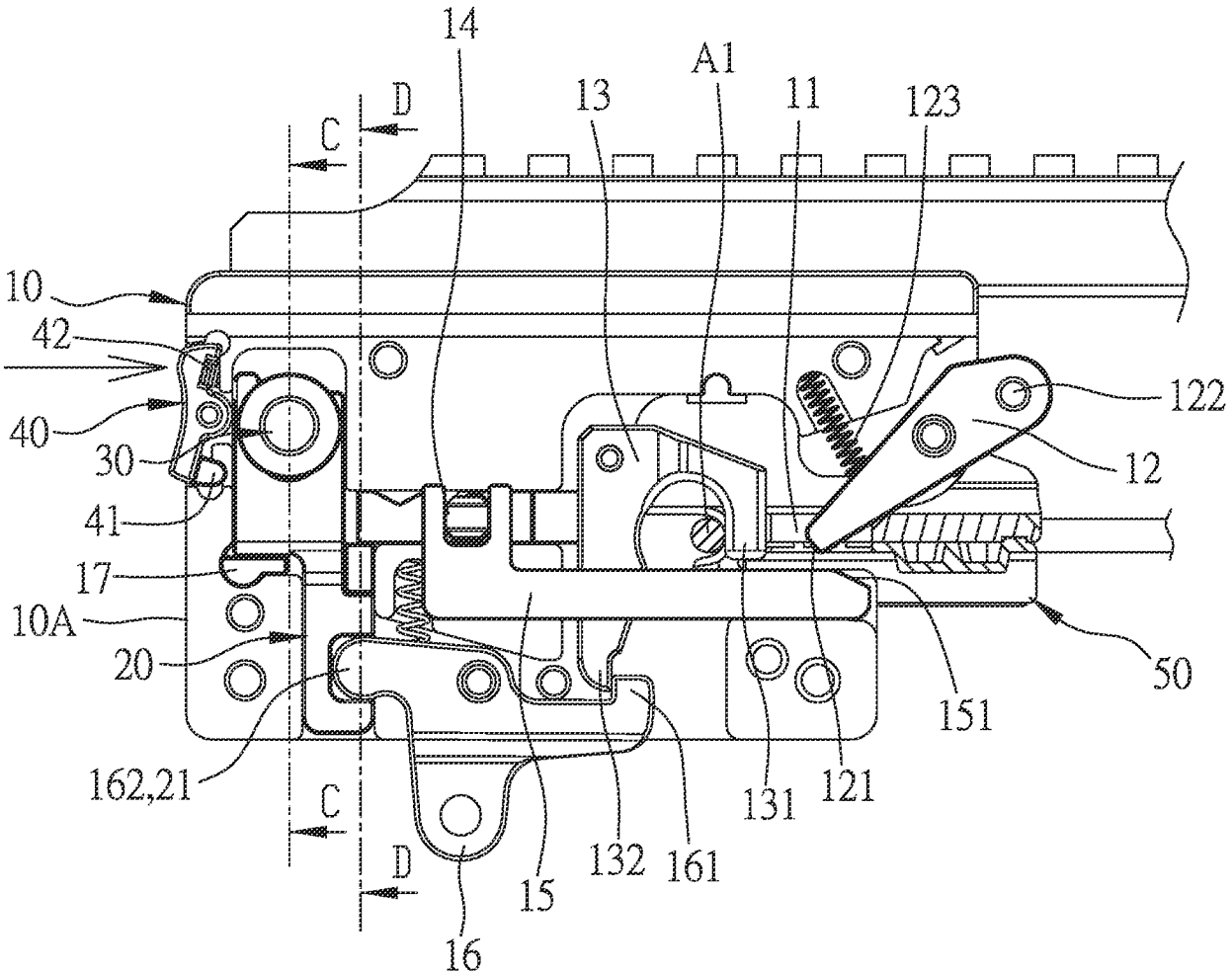
FIG. 8 is a cross sectional view showing the operation of the trigger reset device according to the preferred embodiment of the present invention.
Figure 9:
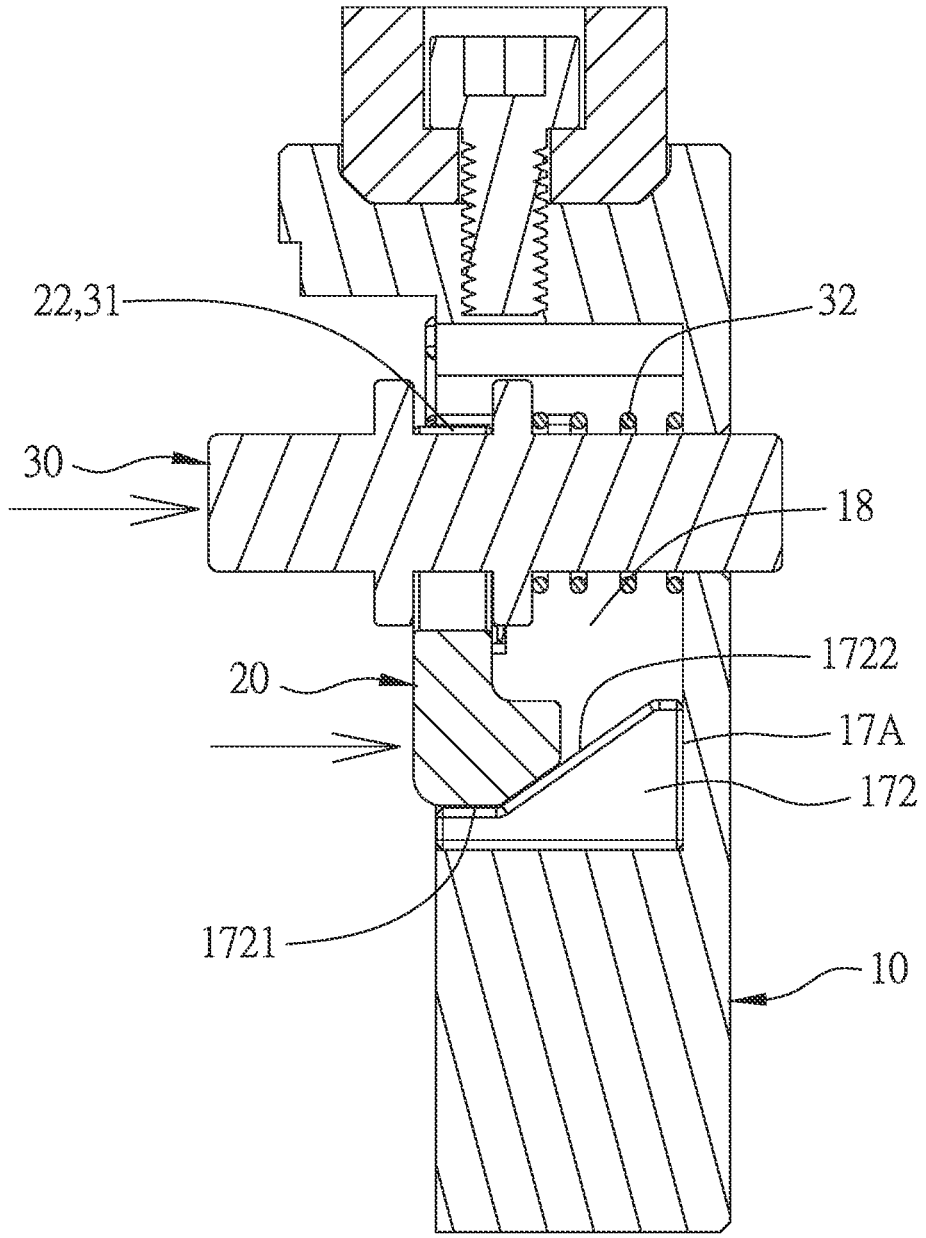
FIG. 9 is a cross sectional view taken along the line C-C of FIG. 8.
Figure 10:
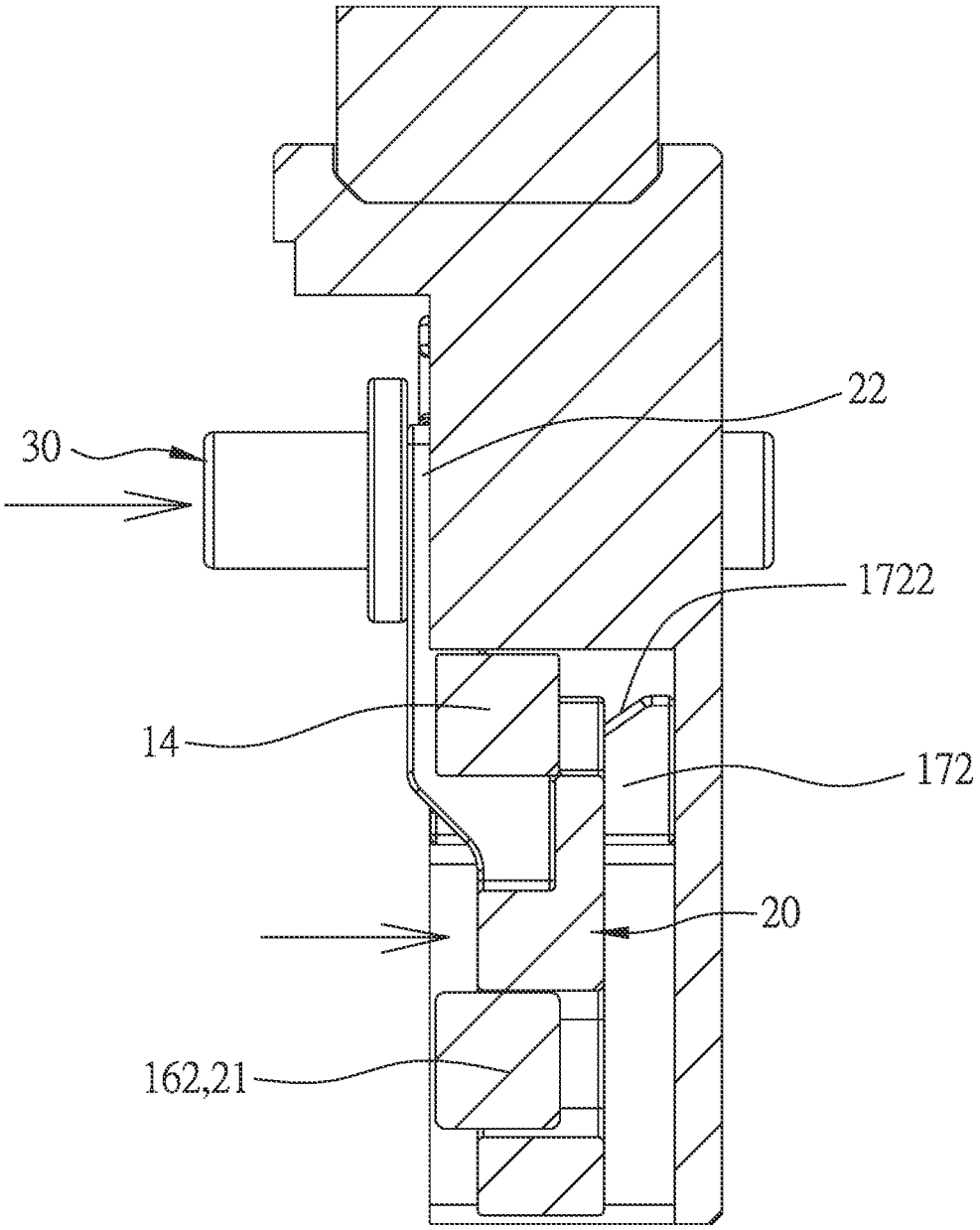
FIG. 10 is a cross sectional view taken along the line D-D of FIG. 8.
Figure 11:
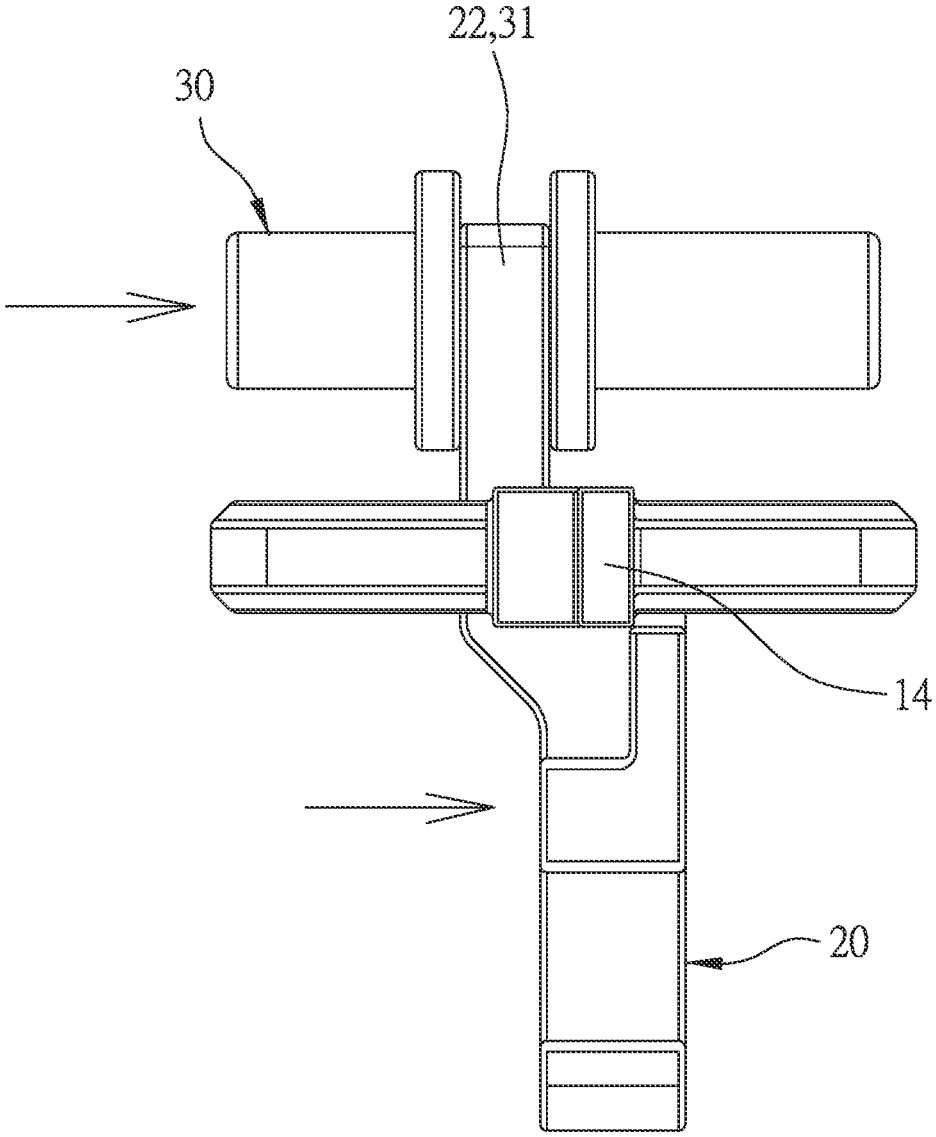
FIG. 11 is also another side plan view showing the operation of the trigger reset device according to the preferred embodiment of the present invention.
Figure 12:
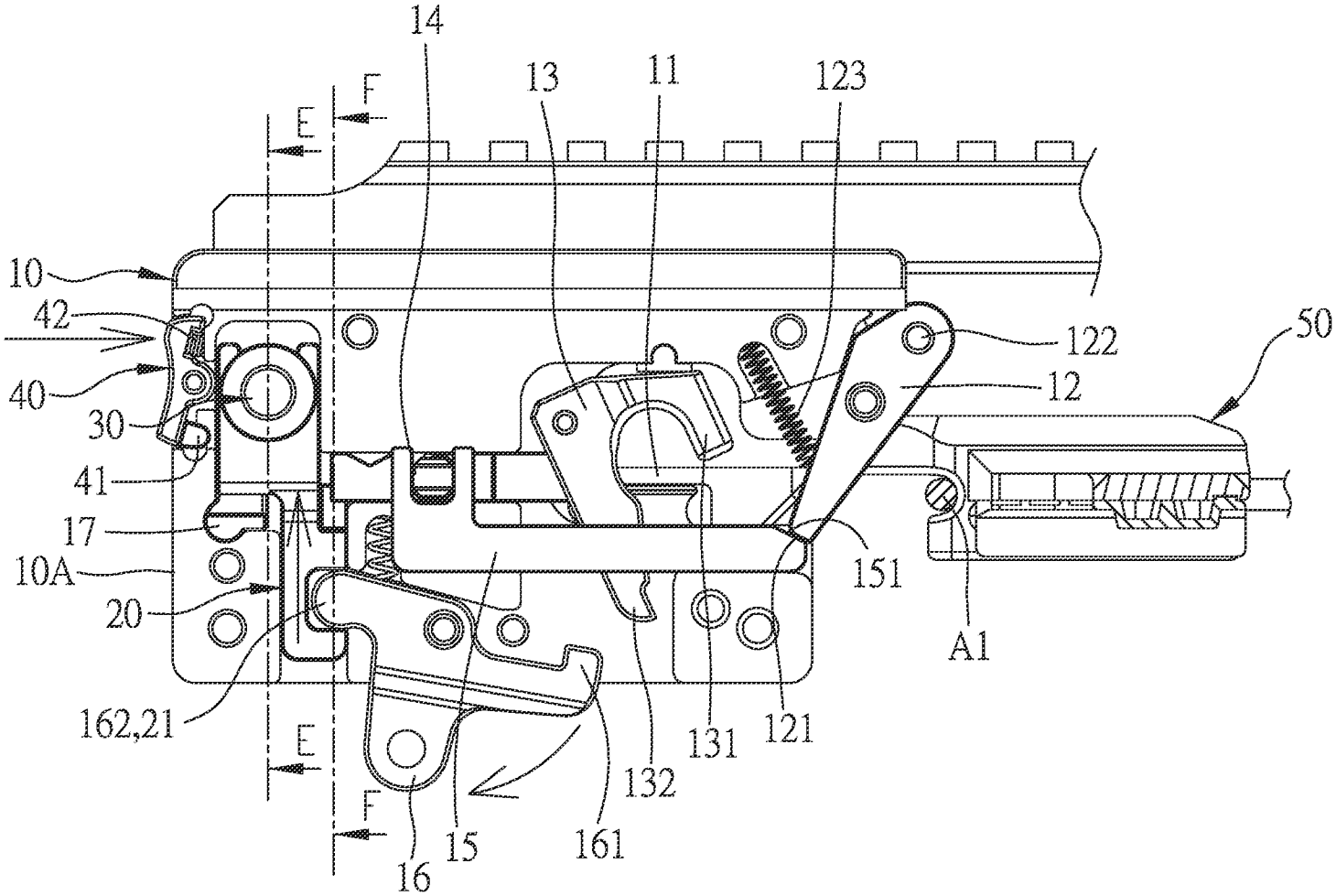
FIG. 12 is another cross sectional view showing the operation of the trigger reset device according to the preferred embodiment of the present invention.
Figure 13:
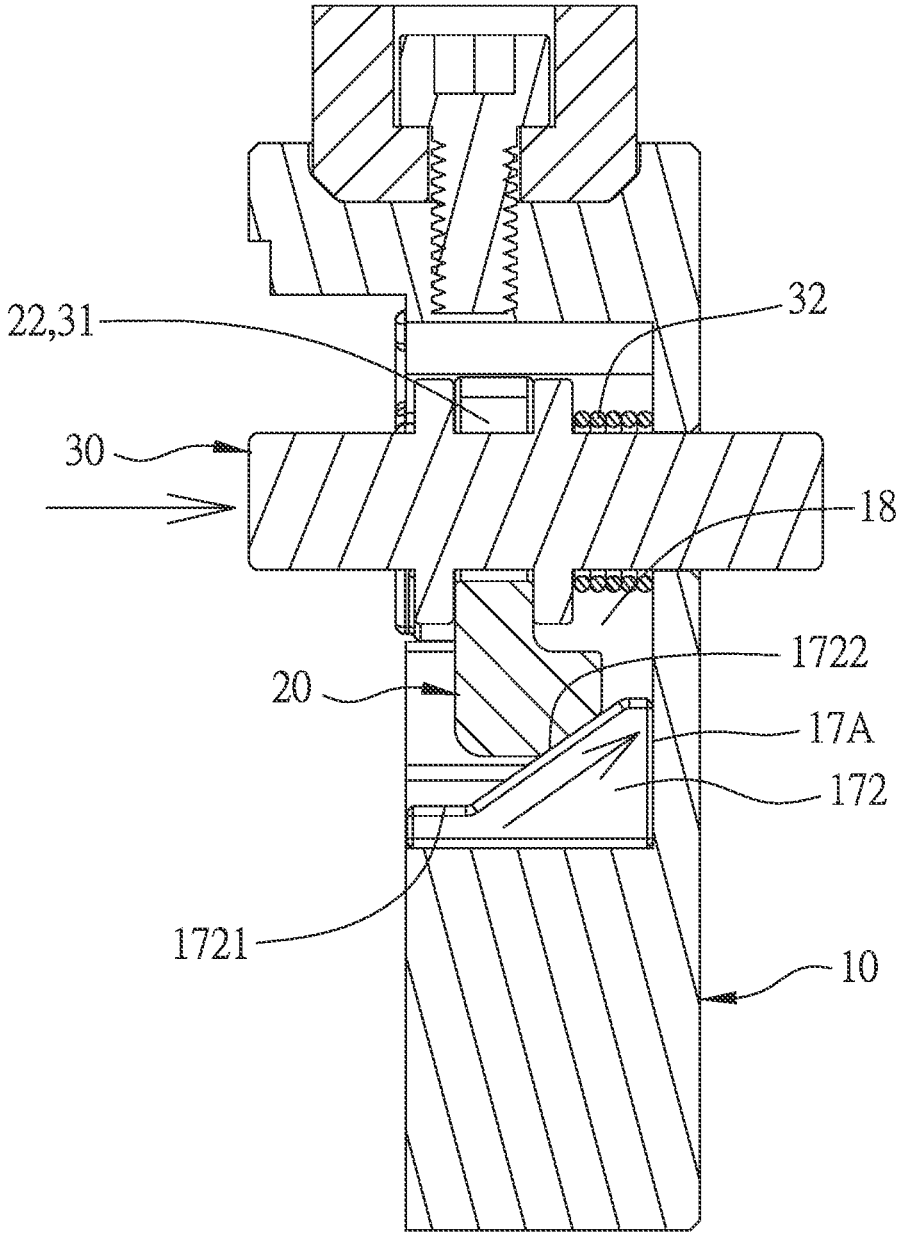
FIG. 13 is a cross sectional view taken along the line E-E of FIG. 12.
Figure 14:
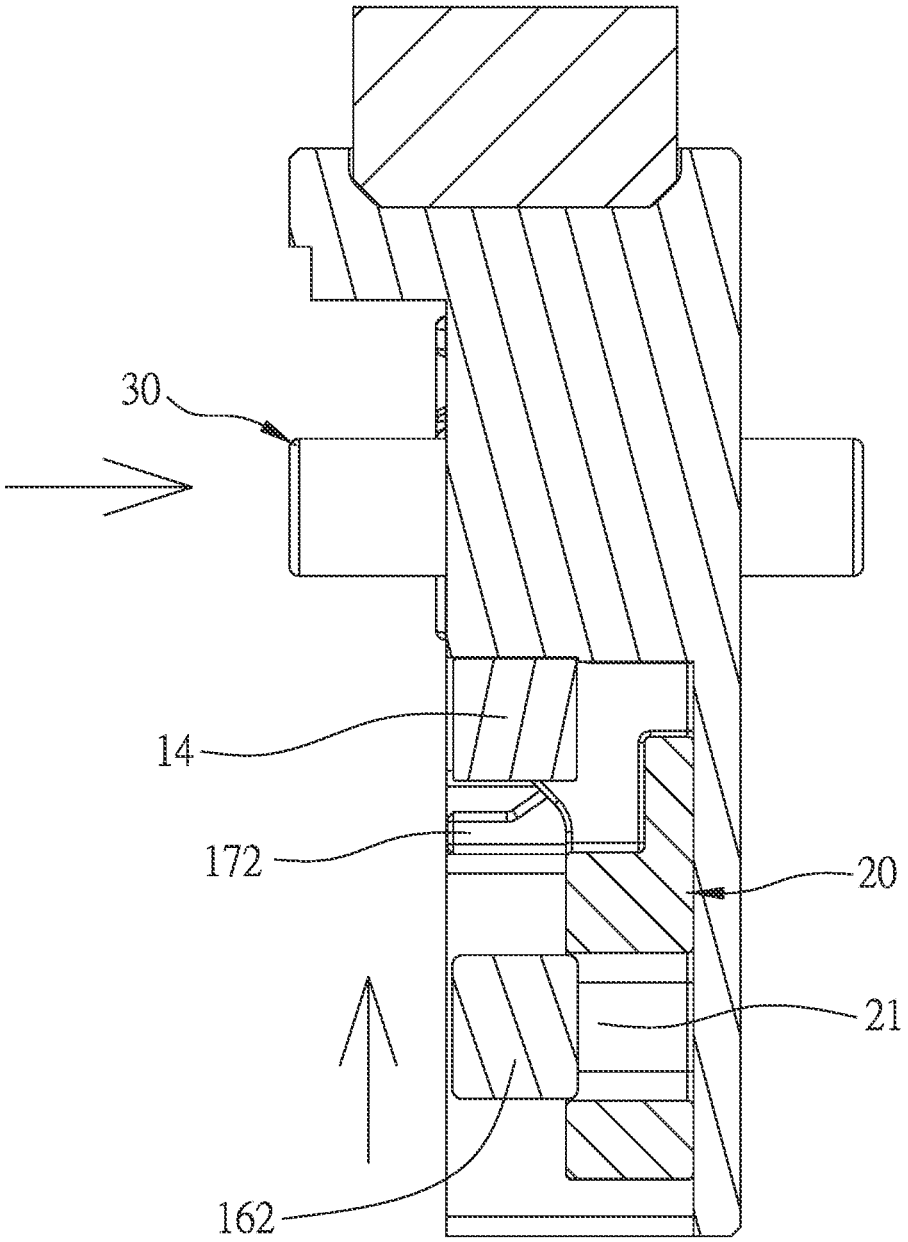
FIG. 14 is a cross sectional view taken along the line F-F of FIG. 12.
Figure 15:
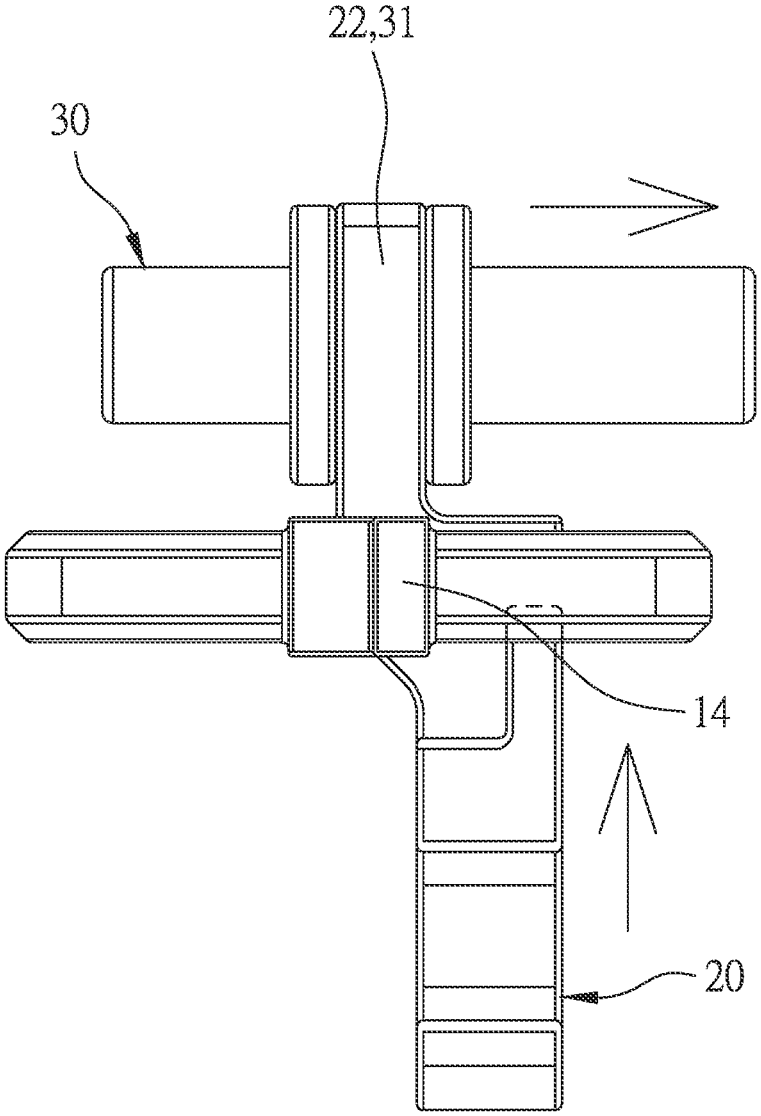
FIG. 15 is still another side plan view showing the operation of the trigger reset device according to the preferred embodiment of the present invention.

As desiring to reset, as shown in FIGS. 8-11, the movable safety switch 14 is fixed on the closing position 14A, a string puller 50 is placed to pull the string A1, then the engagement switch 40 is pressed manually to remove the locating portion 41 from the drive element 20 so that the drive element 20 is not stopped by the locating portion 41 of the engagement switch 40 and the button 30 is pressed, such that the button 30 actuates the drive element 20 to move horizontally along the plane 1721 of the guide protrusion 172, and the drive element 20 removes from the movable safety switch 14. Referring further to FIGS. 12-15, the button 30 is pressed continuously to actuate the drive element 20 to move upward along the tilted face 1722 of the guide protrusion 172, the drive element 20 drives the connection trigger 16 to move, the locating portion 41 of the engagement switch 40 detaches from the retaining portion 132 of the string hook 13, and the string hook 13 is pushed by the second spring 133 to remove the hooking portion 131 from the channel 11, hence the string A1 is removed from the hooking portion 131 of the string hook 13 so that the string puller 50 releases the string A1 slowly to be reset.

Thereby, the trigger reset device of the present invention has advantages as follows:

After drawing the string A1, the movable safety switch 14 is fixed on the closing position 14A, the engagement switch is pressed, and the button 30 is pressed so that the button actuates the drive element 20 to move upward, and the connection trigger 16 is driven to remove from the string hook 13, hence that the string A1 is released to be reset, thus enhancing using convenience.

While various embodiments in accordance with the present invention have been shown and described, it is clear to those skilled in the art that further embodiments may be made without departing from the scope of the present invention.

What is claimed is:

1. A trigger reset device comprising:

a trigger seat including a channel extending backward from a middle section of a front end of the trigger seat, a string hook rotatably connected in the trigger seat, a movable safety switch fixed on a rear end of the channel of the trigger seat, wherein the movable safety switch is movably switched between an opening position and a closing position, and the trigger seat includes a connection trigger rotatably connected proximate to a bottom of the trigger seat, wherein a first end of the connection trigger controls the string hook, and the connection trigger has an actuation portion formed on a second end thereof, the trigger seat further includes a receiving groove and a coupling trench which are defined adjacent to a rear end of the trigger seat, and the receiving groove is in communication with the coupling trench, the receiving groove has a lifting means;

a drive element slidably received in the receiving groove of the trigger seat, and the drive element including a slot defined adjacent to a bottom of the drive element and configured to engage with the actuation portion of the connection trigger, wherein the drive element also including a controlled unit arranged on a top thereof;

a button including a slidable sleeve portion configured to slidably connect the button on the controlled unit of the drive element and to move with the lifting means, wherein when the button is pressed and matches with the lifting means, the drive element is actuated to move upward, and when releasing the button, the drive element moves downward to an original position; and an engagement switch rotatably accommodated in the coupling trench of the trigger seat, and the engagement switch including a locating portion formed on an end of the engagement switch, a fifth spring defined between the engagement switch and the trigger seat, hence the fifth spring abuts against the engagement switch so that the drive element is stopped by the locating portion of the engagement switch in the normal state and the button does not move to actuate the drive element to move;

wherein when the movable safety switch is located on the closing position, the engagement switch is pressed so that the drive element is not stopped by the locating portion of the engagement switch, and the button is pressed so that the button actuates the drive element to move upward, and the drive element drives the connection trigger to removes from the string hook.

2. The trigger reset device as claimed in claim 1, wherein the trigger seat includes a first lid and a second lid covered with the first lid.

3. The trigger reset device as claimed in claim 1, wherein an arrow retainer has an abutting portion formed on a first end thereof, and the arrow retainer has a defining portion formed on a second end of the arrow retainer, a first spring defined between the arrow retainer and the trigger seat, such that the arrow retainer is pushed by the first spring to movably abut against the defining portion and is limited by the defining portion; the stop element has a limited portion formed on an end thereof away from the movable safety switch and stopped by the abutting portion.

4. The trigger reset device as claimed in claim 1, wherein the string hook has a hooking portion formed on a first end thereof, a retaining portion formed on a second end thereof, and a second spring defined between the string hook and the trigger seat so that the string hook is pushed by the second spring, wherein the retaining portion extends below the channel.

5. The trigger reset device as claimed in claim 1, wherein a third spring is defined between the connection trigger and the trigger seat, such that the connection trigger is pushed by the third spring, wherein the connection trigger is not triggered in a normal state, a fourth spring is defined between the button and the trigger seat and is configured to push the button to move back to an original position after pressing the button.

6. The trigger reset device as claimed in claim 1, wherein the lifting means has a stepped portion formed on a middle section of the receiving groove, wherein the stepped portion has a plane and a tilted face obliquely extending upward from the plane.

7. The trigger reset device as claimed in claim 6, wherein the stepped portion of the receiving groove has a guide protrusion connected with the stepped portion, and the guide protrusion has the plane and the tilted face.

8. The trigger reset device as claimed in claim 1, wherein when the movable safety switch is located on the closing position, the drive element is stopped by the movable safety switch to not slide upward, so the connection trigger is not be triggered, wherein the movable safety switch is connected with a stop element extending forward.

9. The trigger reset device as claimed in claim 1, wherein the button includes a slidable sleeve portion configured to slidably connect the button on the controlled unit of the drive element, and a portion of the button extends out of the trigger seat.

10. The trigger reset device as claimed in claim 1, wherein the trigger seat includes an arrow retainer rotatably connected proximate to the front end of the trigger seat, and the connection trigger has a fastening portion extending from a first end thereof, wherein the fastening portion is configured to engage the string hook, thus controlling the string hook.

* * * * *